US006655497B1

(12) United States Patent
Weatherall

(10) Patent No.: US 6,655,497 B1
(45) Date of Patent: Dec. 2, 2003

(54) STABILIZER FOR LADDERS

(76) Inventor: Barrie Weatherall, 1 Fairfax Street, Bishophill, York, Y01 6EB (GB)

( * ) Notice: Subject to any disclaimer, the term of this patent is extended or adjusted under 35 U.S.C. 154(b) by 0 days.

(21) Appl. No.: 09/958,114

(22) PCT Filed: Apr. 12, 2000

(86) PCT No.: PCT/GB00/01391

§ 371 (c)(1),
(2), (4) Date: Oct. 3, 2001

(87) PCT Pub. No.: WO00/65191

PCT Pub. Date: Nov. 2, 2000

(30) Foreign Application Priority Data

| | | |
|---|---|---|
| Apr. 21, 1999 | (GB) | 9908992 |
| Sep. 3, 1999 | (GB) | 9920698 |
| Mar. 14, 2000 | (GB) | 0005944 |

(51) Int. Cl.[7] ..... E04G 5/02

(52) U.S. Cl. ..... 182/108; 182/201; 182/204; 248/188.8

(58) Field of Search ..... 182/107, 108, 182/201, 204, 111; 248/188.8

(56) References Cited

U.S. PATENT DOCUMENTS

| | | | | | |
|---|---|---|---|---|---|
| 3,937,298 | A | * | 2/1976 | Hurwitz | 182/200 |
| 4,085,820 | A | * | 4/1978 | Cerny | 182/204 |
| 4,175,641 | A | * | 11/1979 | Reyes | 182/172 |
| 4,331,217 | A | * | 5/1982 | Stecklow | 182/214 |
| 4,607,726 | A | | 8/1986 | Davis et al. | |
| 5,064,024 | A | | 11/1991 | Barham | |
| 5,222,814 | A | * | 6/1993 | Boelryk | 384/47 |
| 5,279,387 | A | * | 1/1994 | Swiderski et al. | 182/27 |
| 5,341,899 | A | | 8/1994 | Casamento | |
| 5,417,302 | A | | 5/1995 | McElfresh | |
| 5,449,100 | A | * | 9/1995 | Eckhart | 224/509 |
| 5,526,898 | A | * | 6/1996 | Clark | 182/200 |
| 5,678,656 | A | | 10/1997 | Lanzafame | |
| 5,704,451 | A | * | 1/1998 | King | 182/204 |
| 5,749,811 | A | * | 5/1998 | Wilson | 482/71 |

* cited by examiner

*Primary Examiner*—Bruce A. Lev

(57) ABSTRACT

A stabiliser for ladders comprises a rigid, generally flat base (10; 71) having a linear channel (11; 70) extending along a first, upper surface thereof, which channel is defined by a pair of generally parallel, upwardly-extending side members having upper edges directed towards each other, and at least one ladder attachment (18, 19; 30, 35; 50, 53) by means of which a ladder stile (17; 66, 67) may be extended downwardly.

18 Claims, 5 Drawing Sheets

STABILIZER FOR LADDERS

The present invention is a stabiliser for ladders.

When a ladder is installed for use in an inclined position against a wall, instability of the lower end of the ladder may arise from various sources. For example, if the ladder is inclined to the ground at too shallow an angle, or if the ground surface is unduly irregular or of limited friction, such as when the surface is wet, there may be a serious risk of the foot of the ladder slipping away from the wall, with potentially catastrophic consequences. In UK Patent Specification No. 2216168 I have described a ladder stabiliser which I devised to deal with the foregoing problem and in practice, that stabiliser has proved very effective in a wide range of conditions for preventing the slippage of the ladder foot away from a wall.

However, there is the further problem of lateral slippage, most usually of the upper end of a ladder, which can arise when the surface upon which the foot of the ladder is placed is inclined in a direction which is generally parallel to the surface of the wall, that is sideways relative to the plane of the ladder. In an attempt to overcome this problem, various devices have been proposed, for attachment to the individual ladder feet with the aim of extending one or both of the ladder stiles. By way of example, UK Patent Specification No 1578143 describes and illustrates one form of device for attachment to the lower end of a ladder stile in order to extend the stile; if appropriate, a device of this type may be attached to each ladder stile.

Unfortunately, the leg attachments of UK Specification No 1578143 provide no protection against slippage of a ladder foot outwardly away from a wall, except to the extent that the attachments may include rubber or related components to somewhat enhanced grip.

It is therefore an object of the present invention to provide a form of ladder stabiliser by means of which the danger of slippage of the ladder feet outwardly away from wall, and also the danger of sideways slippage of the ladder feet generally parallel to a wall, may both be countered.

The ladder stabiliser according to the present invention comprises a rigid, generally flat base having a linear channel extending along a first, upper surface thereof, which channel is defined by a pair of generally parallel, upwardly-extending channel side members having upper edges directed towards each other, and at least one ladder attachment by means of which a ladder stile may be extended downwardly.

In use of the ladder stabiliser, one or preferably two of the ladder attachments are attached to one or both of the ladder stiles and then the attachments are introduced into the channel. Most preferably, the lateral dimension of each ladder attachment is such that it is greater than the distance apart of the upper edges of the channel side members, such that the ladder attachments may only be introduced into the channel from one end thereof—and will remain therein when the ladder is lifted.

Thus, by means of the ladder stabiliser as herein defined, a ladder may be modified both to counter the effects of ground slope in the direction of the width of the ladder and also to enhance the resistance of the foot of the ladder to slippage away from a wall. With the latter consideration in particular in mind, it is strongly preferred that the lower surface of the ladder stabiliser be of enhanced frictional value, for example in the form of a rubber or like surface and/or with surface irregularities, as described below.

The channel, defined by its generally parallel, upwardly-extending side members, may be of various possible cross-sectional shapes, subject only to the requirement that the upper edges of the side members are directed towards each other. Thus, by way of example, the channel side members may be generally parallel to each other, with their upper edges turned inwardly from the side members, for example at right angles thereto. As one alternative, the side members may simply be shaped so as to define a channel of which the widest lateral dimension is at a lower level than the open top of the channel, for example, by their being inwardly inclined in an upward direction.

The channel preferably extends throughout the length of the base but may extend for less than that length if desired.

In one preferred form of the stabiliser according to the present invention, the channel is mounted upon a separate base. Conveniently, that base may in turn have a uniform cross-sectional shape and may be formed by extrusion. In a particularly preferred form, the base is formed of two aligned parts, which may be moved apart from each other in order to provide an extended base for the stabiliser.

The base, whether is be formed integral with the channel or separately, is preferably square, or more preferably rectangular, in plan. In the latter case, the longer dimension of the rectangular base is preferably aligned parallel to the channel.

The underside of the stabiliser, as mentioned above, is preferably of enhanced frictional value. As indicated, this result may be achieved by means of the structure of the undersurface of the stabiliser, for example by irregularities or projections in or from the surface, and/or by forming that surface of a frictional material. In a particularly preferred form of the stabiliser according to the invention, the undersurface is formed of a vulcanised rubber and is moulded in position, preferably with an irregular surface, upon the underside of the base of the stabiliser.

Any risk of slippage of the ladder in a direction which is generally parallel to the plane of the wall or the like against which the ladder is inclined is reduced by means of the ladder attachment or attachments by which each ladder stile may be extended downwardly. One possible form of such stile extender is described in the above-mentioned United Kingdom Patent Specification No. 178143, which was published in November 1980. However, while the device described in that specification would appear to be of potential use for extending the length of the ladder stile, it does exhibit two disadvantages in practice. First of all, the stile is extended by locating an extension member in a selected one of a number of spaced-apart transverse slots. However, in order to impart integrity to the unit in which the extension member is housed, those slots must be spaced apart by sufficient distances to enable the unit to support the whole weight of the ladder and its user. Thus the adjustment of the length of the stile is essentially a step-wise adjustment. Secondly, the necessary design of the device inevitably makes the product relatively expensive to produce and may as a result discourage a potential user from purchasing what could otherwise be an advantageous aid to ladder safety when incorporated in a stabiliser according to the present invention.

With these latter disadvantages of such a prior product in mind, I have developed and have described in the specification of United Kingdom Patent Application No 9920698.9 an improved form of levelling support by means of which a ladder stile may be extended, which support comprises an elongated hollow first member for attachment to a ladder stile, an elongated second member slidable linearly within said first member, adjustment means comprising two interengaging non-planar surfaces each associated with one of said first and second members and locking means to secure said surfaces in their mutually interengaged positions. By means of this levelling support, the relative linear movement of the two members may be rendered continuous or nearly so, thereby enabling the support to be matched more closely to the desired extended stile length than was hitherto possible. Secondly, it becomes possible to design and construct the levelling support more readily and potentially more cheaply than has hitherto been the case.

Thus this latter form of levelling support or ladder extender may very advantageously be used as a feature of the ladder stabiliser according to the present invention. However, the stabiliser may be used to even greater advantage in combination with one or two ladder attachments of the type described in the specification of my subsequent United Kingdom Patent Application No 0005944.4. In that specification I have described a ladder stile extender which comprises two elongated members one of which is slidable within the other and having means for securing one of said members to a ladder stile and the other of the said members functioning as a stile extender or having means to secure it to a stile extension, a set of generally parallel irregularities associated with each of said members for interengagement with those on the other member, means for pivoting the two sets of irregularities into and out of engagement with each other, and locking means to secure said members together with said sets of irregularities so engaged. It is particularly preferred that the two sets of irregularities be each a set of generally parallel teeth, in particular such teeth extending transverse to the direction of relative movement of the two members. It is a very important advantage of the ladder stile extender described in this last-mentioned patent specification that it is adapted for production in a very simple and relatively inexpensive form, for use internally but more preferably externally upon ladder stiles of a wide range of cross-sectional dimensions; with a high degree of security against ladder collapse.

The invention will now be further described and illustrated, by way of example only, with reference to the accompanying drawings, which illustrate various preferred forms of the ladder stabiliser according to the present invention and wherein.

Figure 1:
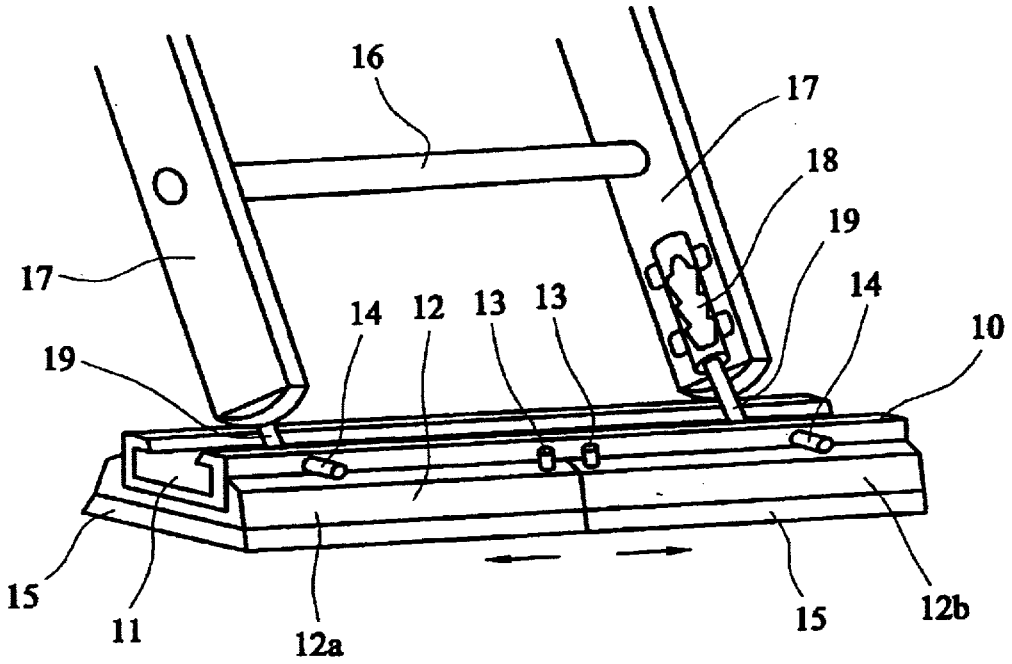
FIG. 1 is a perspective view of a first form of stabiliser, in use supporting and stabilising the foot of a ladder.
Figure 2:
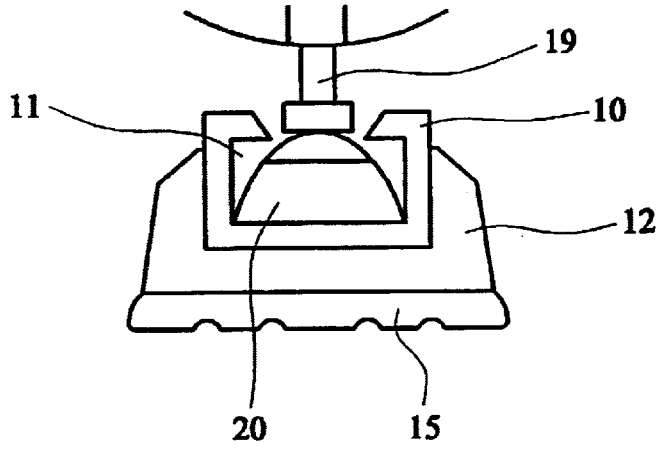
FIG. 2 is an end view of the ladder and stabiliser of FIG. 1.
Figure 3:
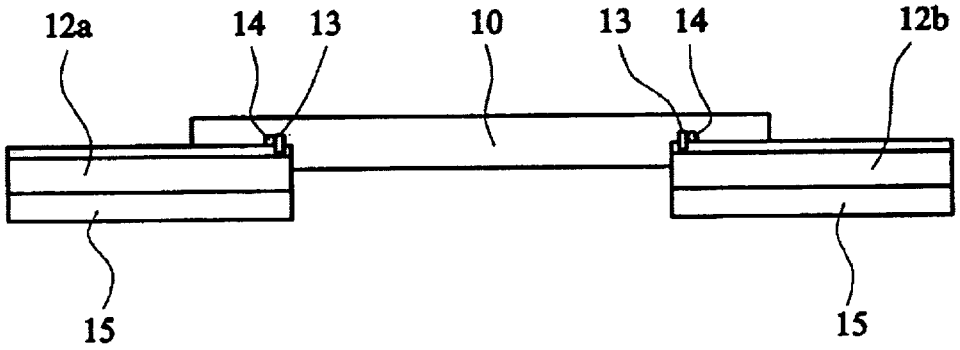
FIG. 3 illustrates the manner in which the base of the ladder stabiliser shown in FIGS. 1 and 2 may be extended.

The ladder stabiliser illustrated in FIGS. 1 to 3 comprises an elongate, extruded channel member 10, of aluminium or an alloy, defining a linear channel 11 extending throughout its length. The member 10 is in turn mounted within an elongate channel formed within an extruded base member 12 of similar or the same material. The base member 12 comprises two aligned parts, 12*a* and 12*b*, which are free to move apart in a linear direction as shown. The amount to which the base member 12 may be extended is limited by bolts 13 projecting upwardly from the parts 12*a*, 12*b*, which at the outer limit of movement of the parts engage bolts 14 extending from the channel member.

The base member parts are in turn each mounted upon a foot 15, formed in vulcanised moulded rubber and having a profiled bottom surface to enhance the resistance to slippage.

In this first illustrated form of the stabiliser, it is in use to stabilise a ladder 16. To the inner face of each of the ladder stiles 17 a leveller 18 is secured. Each leveller takes the form of a bolt 19 which is mounted to extend downwardly from the associated stile and to be secured in the selected extended position. Each bolt 19 carries a shaped rubber foot 20 pivoted upon its lower end. The levellers 18 may be of the type described in UK Patent Specification No 1578143.

The rubber feet 20 are of such a cross-sectional dimension as will enable them to enter the channel 11 from either end thereof but prevents them from being lifted out of the channel at any other point. Thus the whole assembly, comprising the ladder itself, the bolts 19 and associated feet, and the base unit, may be moved as a whole from one installed position to an adjacent one.

As will be apparent, the illustrated stabiliser provides enhanced stability for the ladder against slippage away from a wall against which the ladder is inclined. In addition, extending one or both of the bolts 18 by appropriate different amounts compensates for any inclination of the ground surface in a direction parallel to the wall and thereby stabilises the ladder against lateral slippage also.

The illustrated stabiliser may, by way of example, be of the order of 24 inches (61 cm.) long in its closed condition and be extensible, as illustrated in FIG. 3, to a length of the order 40 inches (102 cm.). Of course, the dimensions may differ from these values, to reflect the intended use of the stabiliser.

Figure 4:
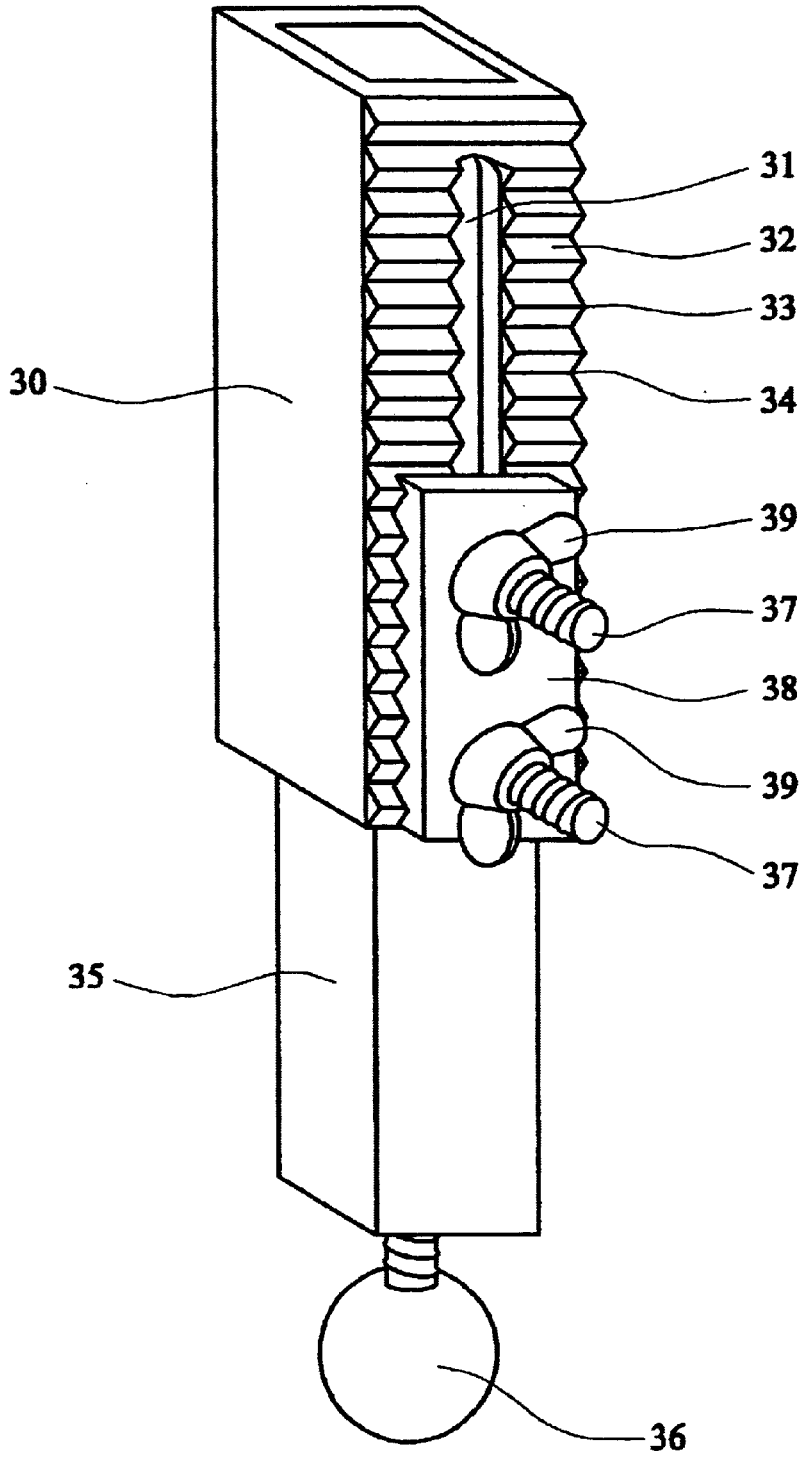
FIG. 4 illustrates, in perspective view, a form of stile extender which is an improvement over that shown in FIGS. 1 and 2.

The stile extender illustrated in FIG. 4 comprises an elongated hollow member 30 of rectangular cross-section which has an elongated aperture 31 in its face 32. The face 32 is shaped with a succession of alternating angular ridges 33 and troughs 34. A solid inner member 35 is a close sliding fit within the hollow member 30 and carries a spherical foot 36 at its lower end.

Two bolts 37 project outwardly from the inner member 35 through the aperture 31. A locking member 38, which on its face towards the member 30 is shaped with ridges and troughs matching those on the face 32, may be secured against that face by means of wing nuts 39. By tightening these wing nuts in this way, the inner member 35 and hollow member 30 may be fixed together in a selected relative position in which the member 35 projects downwardly from the member 30 to the desired extent.

In use, two stile extenders of the type illustrated in FIG. 4 are secured to the inner faces of the stiles of a ladder and the spherical feet 36 of the stile extenders are introduced into an elongate channel, of part-circular cross-section, formed within an extruded aluminum channel member (not shown) corresponding to the channel member 10 of FIGS. 1–3.

The stile extenders of the type shown in FIG. 4 function in essentially the same manner as the levellers 18 which are a feature of the stabiliser illustrated in FIGS. 1 to 3 but have the specific advantage that the adjustment of the amount by which they extend downwardly from the associated ladder stiles is much finer and therefore advantageous.

Figure 5:
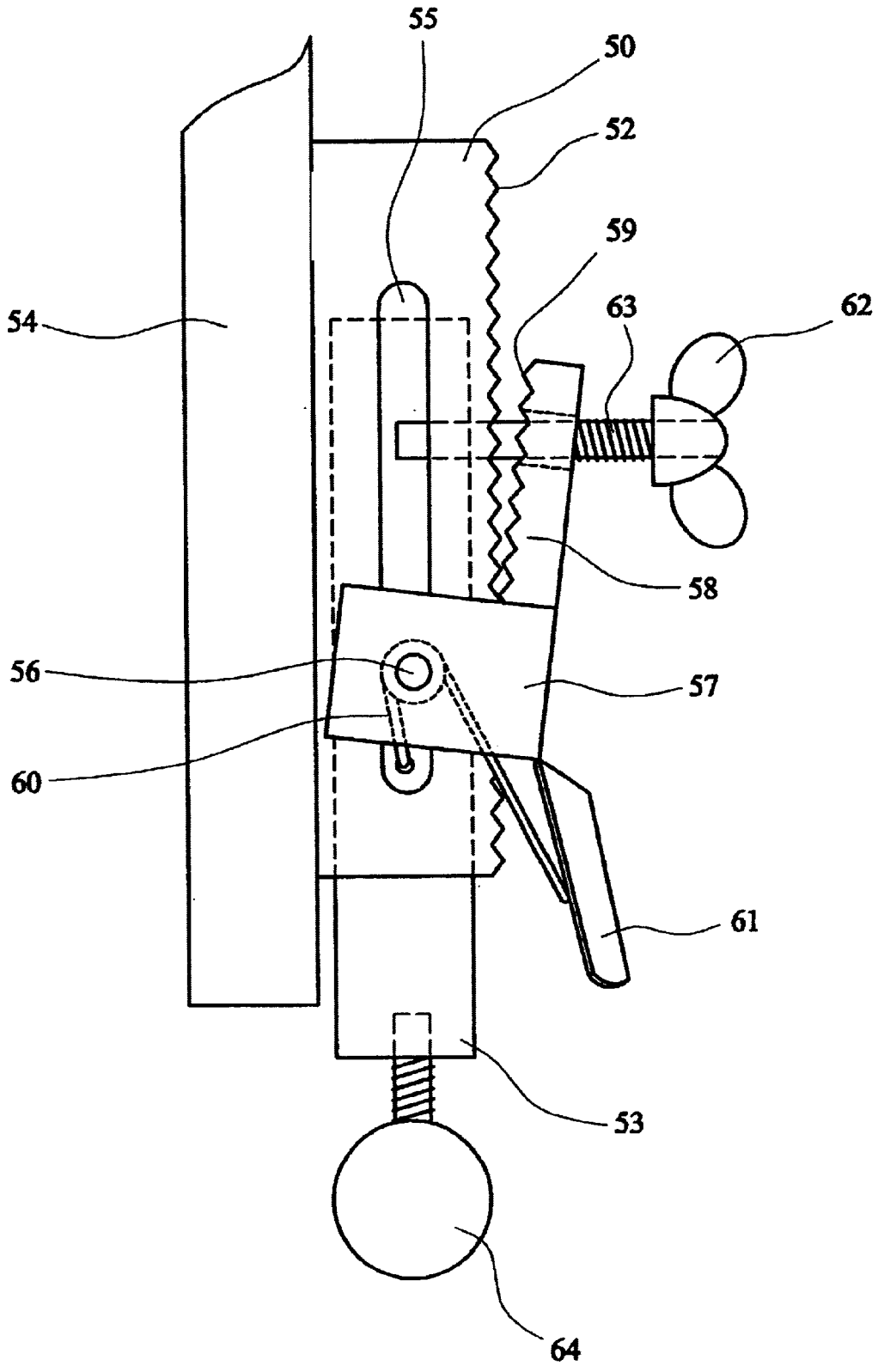
FIG. 5 illustrates, in an elevation from one side, a further form of stile extender which may advantageously be included in another form of the ladder stabiliser according to the present invention.
Figure 6:
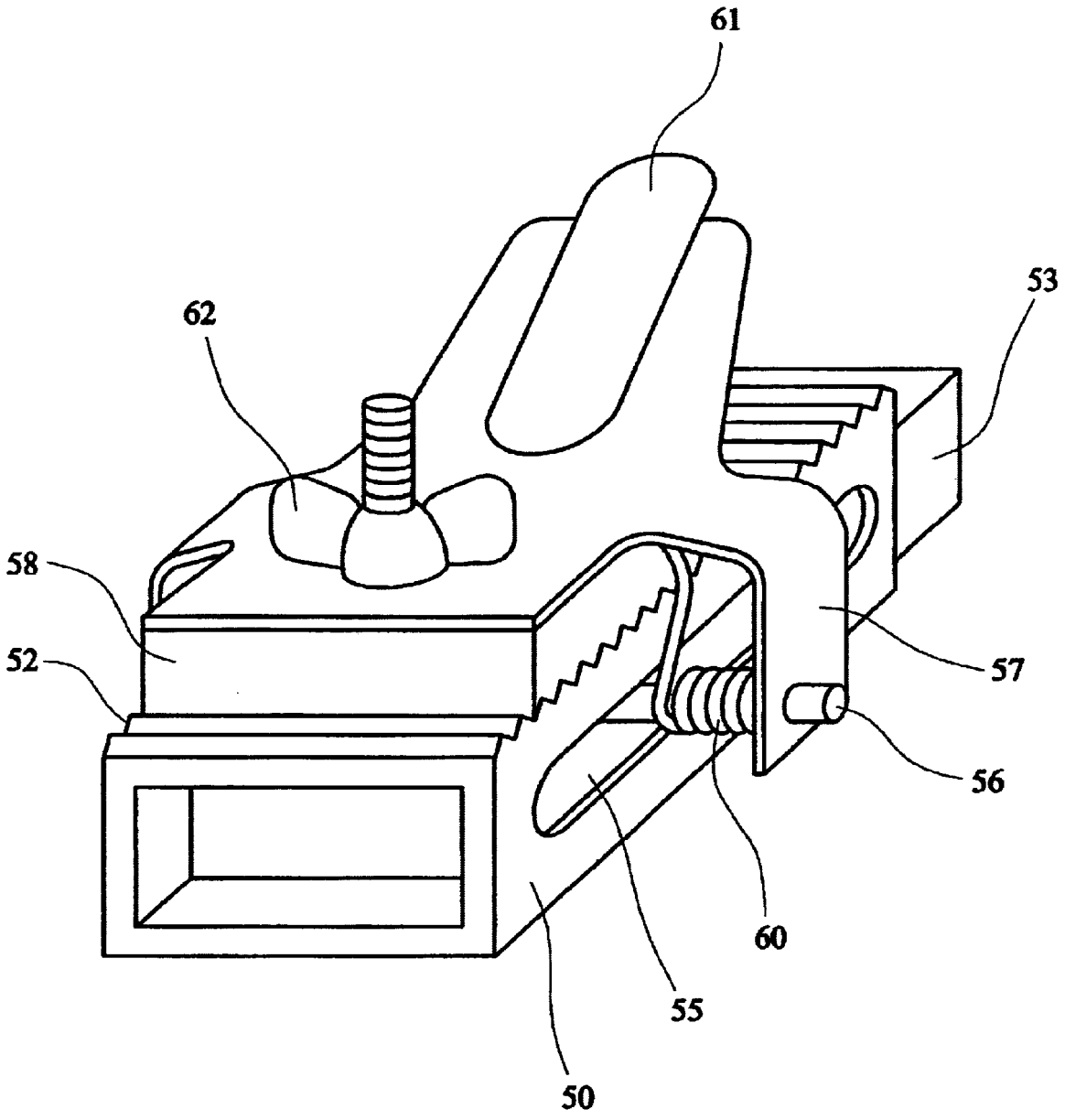
FIG. 6 illustrates the stile extender of FIG. 5 in perspective view.
Figure 7:
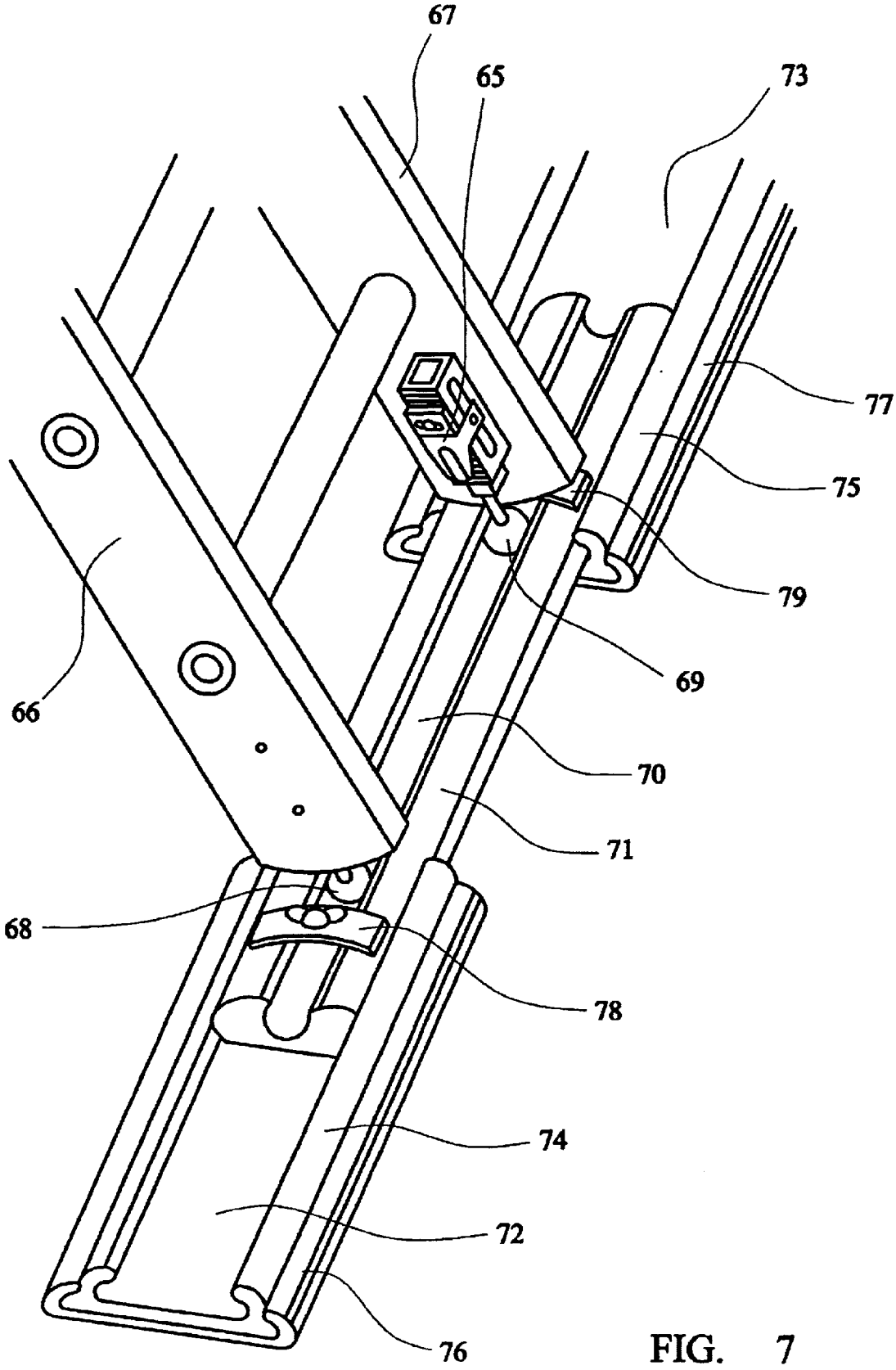
FIG. 7 is a perspective view of a further form a ladder stabiliser according to the present invention, incorporating a stile extender as illustrated in FIGS. 5 and 6.

A particularly preferred form of the ladder stabiliser according to the present invention is illustrated in FIG. 7 and incorporates two stile extenders of the preferred form illustrated in FIGS. 5 and 6.

The stile extender illustrated in FIGS. 5 to 7 comprises an elongated hollow member 50 of generally rectangular cross-section, the face 51 of which is shaped with a succession of alternating angular ridges and troughs together forming a continuous series of parallel teeth 52. A solid or hollow inner member 53 is of such dimensions as to be an easy sliding fit within the hollow member 50. The member 50 is secured by means not shown, for example by bolts, to the lower end of a ladder stile 54.

The hollow member 50 has an elongated aperture 55 in each of its two opposing sides and a linear pivot 56 extends between and through the apertures 55 and through the inner member 53. Upon its ends, the pivot 55 engages flanges 57 formed on a locking member 58, which is therefore able to swing about the pivot 56 into and out of contact with the member 50. The position of the pivot 56 is such that teeth 59 on the near face of the locking member 58 are thus able to engage and disengage the teeth 52 on the member 50.

A spiral spring 60 encircling the pivot 56 urges the member 58 to swing about the pivot into contact with the toothed face of the member 50 and for the teeth 52 and 59 to engage each other so as to prevent relative linear movement of the members 50 and 53. The two sets of teeth may in principle be disengaged by means of pressure, applied manually or by the user's foot, on a lever 61 formed on the locking member 58. In this way, the extent to which the member 53 projects downwardly from the member 50 may be increased or reduced as desired. However, when that desired extent of projection has been achieved, then the two members are secured together by the tightening of a wing nut 62 carried upon a screw 63 projecting from the member 53.

Thus when an illustrated stile extender is fitted to one of the stiles 54 of a ladder as described, the member 53 may be adjusted until it extends sufficiently to compensate for the inclination of the ground surface across the plane of the ladder. At its lower end, the inner member 53 supports a spherical foot 64. The dimension of the foot 64 and the position of attachment of the stile extender to the ladder stile are such that the foot may be retracted to a position in which it does not project beyond the bottom of the stile when it is not in use.

FIG. 7 shows two stile extenders 65 fitted to the inner faces of the two stiles 66 and 67 of a ladder. The feet 68 and 69 of the extenders are both spherical and they are each a sliding fit within a part-cylindrical channel 70 formed within an extruded channel member 71. The channel member 71 is in turn supported within channels 72 and 73 formed respectively in extruded base member parts 74 and 75. The base member parts are designed to be movable apart linearly to a limited extent, in order to form an extended base for the ladder. Each of these parts is in turn mounted upon a foot 76 or 77, formed in vulcanised moulder rubber and each having a profiled bottom surface to enhance the resistance to slippage of the ladder.

Movement apart of the two base 74/76 and 75/77 may be limited in the same manner as in the case of the ladder stabiliser shown in FIGS. 1 to 3 by the provision of limiting bolts similar to the bolts 13, 14 illustrated in those figures. In addition, while the stabiliser of FIG. 7 may readily be used without modification upon ladders of different dimensions, retainers 78, 79 may be provided to keep the stabiliser loosely secured to the ladder upon which the stabiliser is currently in use, to enable the ladder and stabiliser to be moved as a single unit if desired.

As will readily be understood, a particular advantage of the ladder stabiliser according to the present invention, especially in its illustrated preferred forms, is that, while it affords the desired stability against slippage of a ladder to which it is currently linked, it may readily be separated from that ladder to enable it to be used with another ladder, which latter may be of different dimensions from the first ladder. In addition the ladder stabiliser may work to prevent or reduce the risk of sideways slippage of the ladder top. For example, if the base of the stabiliser extends to one metre at the foot of the ladder, it may prove to be very effective in stopping the top end of a 16-foot (approx. 5 metre) ladder from slipping sideways.

What is claimed is:

1. A ladder stabiliser which comprises a rigid, generally flat base having a linear channel extending along a first, upper surface thereof, which channel is defined by a pair of generally parallel, upwardly-extending channel side members, at least one attachment means securable to a ladder stile, said attachment means including two elongated members, one of which is slidable within the other, and having means for securing one of said members to a ladder stile and the other of said members functioning as a site extender, a foot member being joined to the other said elongated member for positioning in said channel, such that the other said elongated member is pivotally movable with respect to said channel in a first longitudinal direction parallel to said channel and in a second direction transverse to said channel, and is pivotally movable with respect to said channel at any angle between the first longitudinal direction and the second transverse direction, said foot member being of a size and shape that permits relative slidable movement between said foot member and said channel in said first longitudinal direction and said channel side members have upper edges directed towards each other, such that the widest transverse dimension of said channel is at a lower level than the open top of said channel, and such that the corresponding widest transverse dimension of said foot member within the channel is greater than the distance apart of the upper edges of the channel side members.

2. A ladder stabiliser as claimed in claim 1 wherein the channel side members are generally parallel to each other, with their upper edges turned inwardly from the side members.

3. A ladder stabiliser as claimed in claim 1, wherein the channel side members are inwardly inclined in an upward direction.

4. A ladder stabiliser as claimed in claim 1, wherein the channel extends throughout the length of the base.

5. A ladder stabiliser as claimed in claim 1, wherein the channel and the base are separate.

6. A ladder stabiliser as claimed in claim 5, wherein said separate base is of a uniform cross-sectional shape.

7. A ladder stabiliser as claimed in claim 5, wherein said separate base is formed of two aligned parts which may be moved apart from each other.

8. A ladder stabiliser as claimed in claim 1, wherein said generally flat base is rectangular in plan.

9. A ladder stabiliser as claimed in claim 1, wherein the lower surface of said stabiliser is of enhanced frictional value.

10. A ladder stabiliser as claimed in claim 9, having irregularities or projections in or from said lower surface and/or said surface being formed of a frictional material.

11. A ladder stabiliser as claimed in claim 9, wherein said lower surface is of rubber.

12. A ladder stabiliser as claimed in claim 1, wherein the other of said elongated members is formed to permit location in a selected one of a number of spaced-apart transverse slots.

13. A ladder stabiliser as claimed in claim 1, wherein said one elongated member is hollow for attachment to a ladder stile, said other elongated member being slidable linearly within said one elongated member, adjustment means comprising two interengaging non-planar surfaces respectively associated with said one and said other elongated members and locking means to secure said surfaces in their mutually interengaged positions.

14. A ladder stabiliser as claimed in claim 1, including a set of generally parallel irregularities associated with each of said one and said other elongated members for interengagement means for pivoting the two sets of irregularities into and out of engagement with each other, and locking means to secure said one and said other elongated members together with said sets of irregularities so engaged.

15. A ladder stabiliser as claimed in claim 14, wherein said two sets of irregularities are each a set of generally parallel teeth.

16. A ladder stabiliser as claimed in claim 15, wherein said teeth extend transverse to the direction of relative movement of said one and said other elongated members.

17. The ladder stabiliser as claimed in claim 1 wherein said foot member is pivotally joined to the other said elongated member and said foot member has a flat bottom surface and said channel has a flat bottom surface for relative slidable movement between the flat bottom surface of said foot member and the flat bottom surface of said channel.

18. The ladder stabiliser as claimed in claim 1 wherein said foot member is fixedly joined to the other said elongated member, and said foot member is spherical, and said channel is partially cylindrical in cross-sectional to accommodate said foot member for relative slidable movement with respect to said channel.

* * * * *